United States Patent [19]

Carter

[11] 4,009,002

[45] Feb. 22, 1977

[54] PROCESS FOR TREATING TEXTILE FABRIC TO RETARD INFLAMMABILITY

[75] Inventor: William Carter, Greenville, S.C.

[73] Assignee: United Merchants and Manufacturers, Inc., New York, N.Y.

[22] Filed: Feb. 11, 1974

[21] Appl. No.: 441,471

Related U.S. Application Data

[62] Division of Ser. No. 323,655, Jan. 15, 1973, Pat. No. 3,946,497.

[52] U.S. Cl. ..... 8/116 P; 8/149.2; 68/DIG. 5

[51] Int. Cl.[2] ..... D06B 1/16; D06M 1/04

[58] Field of Search ..... 8/116 P, 149.2; 68/DIG. 5

[56] References Cited

UNITED STATES PATENTS

| | | | |
|---|---|---|---|
| 3,398,464 | 8/1968 | Fleissner | 34/122 |
| 3,566,629 | 3/1971 | Fleissner | 68/DIG. 5 |
| 3,787,360 | 1/1974 | Daigle | 8/116 P |
| 3,799,738 | 3/1974 | Wagner | 8/116 P |
| 3,828,589 | 8/1974 | Collinge | 68/DIG. 5 |
| 3,837,796 | 9/1974 | Fleissner et al. | 8/149.2 |

OTHER PUBLICATIONS

Reeves et al., Textile Chemist & Colorist, Aug. 13, 1969, vol. 1, No. 17, pp. 365–369.

Reeves et al. "Chemistry of THPC—"; Colourage Annual 1971, 7 pp.

*Primary Examiner*—Allan Lieberman
*Attorney, Agent, or Firm*—Michael A. Caputo; John P. McGann

[57] ABSTRACT

Textile fabric previously impregnated with THPOH is treated to retard inflammability by passage therethrough of toxic ammonia gas in apparatus which permits the THPOH—$NH_3$ reaction to be carried out in a sealed chamber preventing escape of the toxic gas. The invention operates to confine the gas in a flow path whereby substantially all of the gas flowing through the apparatus is passed directly through the fabric. The fabric is passed through the sealed chamber by means of gas-tight entrance and exit portals. A perforated drum is mounted within the chamber and the fabric is passed about the perimeter of the drum. Sealing elements cooperating with the drum confine ammonia gas introduced into the interior of the drum to flow only through those perforations covered by fabric. Undue accumulation of water which is a product of the reaction is avoided by both the slanted ceiling configuration of the chamber which promotes condensate runoff and the positive gas flow velocity established within the chamber which tends to draw water vapor from the reaction site.

5 Claims, 6 Drawing Figures

PROCESS FOR TREATING TEXTILE FABRIC TO RETARD INFLAMMABILITY

This application is a division of copending application Ser. No. 323,655, filed on Jan. 15, 1973 now U.S. Pat. No. 3,946,497 granted Mar. 30, 1976.

BACKGROUND OF THE INVENTION

The present invention relates to gas treatment of web material, and more particularly to an apparatus and process useful in connection with the manufacture of fire retardant textile fabric. The invention is particularly intended for use in connection with the THPOH—$NH_3$ system of fire-retardant fabric treatment. Tetrakis (hydroxymethyl) phosphonium hydroxide is herein designated THPOH and is the product obtained by adding a base, e.g., NaOH, to tetrakis (hydroxymethyl) phosphonium chloride.

In the manufacture of textile fabrics, the art of rendering various types of materials flame resistant has taken on increasing importance, particularly in connection with fabrics used in the manufacture of wearing apparel. A known system for rendering certain types of textile fabrics flame resistant is the THPOH-$NH_3$ chemical system which is particularly suitable for fibrous materials such as cotton knit and flannelette fabrics, which are among the most common fabrics used for nightwear and the like. Interest in the THPOH—$NH_3$ system has grown steadily since it was first introduced because it can be applied to lightweight fabrics to render them flame resistant without adversely affecting other properties of the material. Generally, fabrics treated by this process have an improved strength retention, good hand and they may be processed in a manner which maintains their durability to repeated laundering. Thus, the THPOH-$NH_3$ system has taken on increasing importance in connection with textile manufacture and, accordingly, greater need arises for apparatus and methods whereby this system may be more advantageously utilized in high-volume production facilities.

The THPOH—$NH_3$ chemical system is usually practised by first treating the textile fabric with the THPOH, which becomes impregnated into the fabric. Subsequently, the fabric is exposed to ammonia gas which reacts with the THPOH to form a polymer in the fabric thereby enhancing the flame resistance of the fabric. After exposure to ammonia gas, the fabric is usually caused to undergo subsequent treating procedures, such as an oxidation step. But for the purposes of the present invention, it is only significant to consider the fact that fabric impregnated with the THPOH must be subsequently treated with ammonia gas and that during this procedure certain very significant problems and difficulties will arise which may seriously impede the effectiveness of the treatment. Thus, for the purposes of the present disclosure it is not deemed necessary to provide extensive details of the chemical aspects of the THPOH-$NH_3$ system inasmuch as this information may be obtained from prior art publications such as U.S. Pat. No. 3,607,356, incorporated herein by reference. From these publications it will be seen that various approaches may be utilized with regard to the chemical aspects of the process and that from the point of view of the apparatus which is required to effect the process, several difficult problems will be encountered.

One of the more important problems which is encountered relates to the handling of the ammonia gas, which is a highly noxious and toxic gas. Thus, in the fabric treatment process, great care must be taken to avoid the escape of undue amounts of ammonia gas into the environment where the process is being practiced. Since exposure to ammonia gas could have a damaging effect upon workers and other personnel occupying areas in proximity to the treatment equipment, the process whereby the THPOH impregnated fabric is exposed to ammonia gas must be carried out within a sealed chamber.

Prior art techniques for practising this aspect of the treatment process have involved passage of the impregnated fabric through a sealed tank containing an atmosphere of ammonia gas. The fabric is wound upon rollers located within the sealed tank and ammonia gas is caused to flow through the tank in order to expose the fabric thereto. These prior art approaches have generally involved merely filling the internal volume of the tank with ammonia gas and moving the fabric through the tank to effect the needed exposure. Thus, the prior art has almost exclusively practised what is commonly called a "surface adhesion" technique, wherein the impregnated fabric is simply exposed within an atmosphere permeated with ammonia gas. Although it is possible with such prior art techniques to produce a fabric having an acceptable degree of flame resistance, it has been found that many serious drawbacks will arise.

For example, since it is required that the ammonia tank be maintained in a sealed condition it is not feasible to insert and remove fabric from the tank in finite batches. Thus, the fabric must be continuously moved through the tank and as a result there arises a need for an entrance seal and an exit seal through which the fabric may enter and leave the tank without permitting escape of ammonia gas. An added difficulty is the fact that the tank must be capable of handling fabric of different widths. Accordingly, the problem of permitting fabric to move through the tank at speeds sufficient for mass production volume while also maintaining an adequate seal for fabrics of different widths will present severe obstacles to the adoption of the THPOH-$NH_3$ system as a practical approach to the manufacture of flame-retardant fabrics.

Other problems will be encountered which relate to the fact that during the process of exposing the fabric to the ammonia gas, water is formed as a product of the reaction between $NH_3$ and THPOH. If this water is allowed to accumulate within the tank to any significant degree, it will adversely affect the treatment reaction causing fabric to be produced which does not have the required degree of fire retardance. Since the moisture which is produced is a product of the reaction between the ammonia gas and the THPOH, control of moisture content within the treatment chamber will be dependent upon the quantity of ammonia gas which is introduced and the rate of flow with which the reaction products are removed from the tank. With presently known techniques, it has been found virtually impossible to control these important parameters of the treatment process in a manner which avoids the adverse effects of the moisture while producing a satisfactory end product.

Since the prior art relies upon mere exposure of the THPOH-impregnated fabric to ammonia gas, such processes require high level quantities of ammonia within the treatment chamber in order to produce a useable fabric. Furthermore, the time during which the fabric must be exposed to the ammonia is relatively long. Accordingly, reaction products cannot be removed from the tank at elevated flow rates. Otherwise, insufficient fabric exposure to the ammonia gas will result, and an end product which is not sufficiently fire resistant will be produced. However, failure to remove the reaction products at a suitable rate will cause moisture to accumulate at the reaction site thereby inhibiting the THPOH-$NH_3$ reaction and rendering the fabric insufficiently flame resistant.

Therefore, if the THPOH—$NH_3$ system of manufacturing flame resistant fabrics is to achieve practical utilization, it is necessary that there be provided manufacturing apparatus and techniques which will overcome the previously mentioned obstacles.

SUMMARY OF THE INVENTION

Briefly, the present invention proceeds from the discovery that an improved technique for exposing THPOH-impregnated fabric to ammonia gas is to cause the ammonia gas to flow directly through the fabric in a confined flow path rather than merely exposing the fabric within a sealed environment permeated with the ammonia gas.

Thus, in its broader aspects, the invention is particularly embodied in apparatus for treating web material with a gas, said apparatus comprising means for flowing said gas in a path through a sealed treatment chamber, means for positioning the web material to be treated within the chamber at a treatment location within said gas flow path, and means constraining substantially the entire amount of said gas flowing in said path at said treatment location to flow directly through said web material.

More specifically, the present invention involves apparatus for treating a continuous length of THPOH-impregnated textile fabric with ammonia gas, said apparatus comprising a sealed treatment chamber, a hollow cylindrical drum mounted within the chamber, gas flow conduits in the drum causing gas to flow from the interior of the drum outwardly thereof, an entrance portal and an exit portal in said sealed chamber for permitting continuous passage of said fabric through the interior of the chamber, said entrance and exit portals each including means for obstructing escape of the ammonia gas from within the sealed chamber while the fabric is being passed therethrough, means for directing the fabric passing through the interior of the chamber to extend about the periphery of the drum over the gas flow conduits and across the path of gas flowing therethrough, means for introducing the gas from the exterior of the chamber into the interior of the drum, means for exhausting gas from within the sealed chamber, and sealing means operatively positioned relative to the drum to confine the ammonia gas flowing from the interior of the drum to flow only through the gas flow conduits over which the textile fabric is passing.

The sealing means of the invention comprise a pair of end seal members which are mounted within the drum at axially spaced apart locations to prevent gas flow from the axial ends of the drum, and a longitudinal sealing member which extends along the length of the drum and about a portion of the circumference of the drum for preventing gas flow through portions of the periphery of the drum which are not covered by the textile fabric. Since the textile fabric, as it moves through the sealed chamber and about the perimeter of the drum, cannot extend about the entire 360° of the perimeter of the drum, the longitudinal sealing member is necessary to prevent escape of gas from that portion of the drum perimeter which is not covered by fabric. The end seal members which prevent escape of gas from the axial ends of the drum may be adjusted to selected locations in directions axially of the drum thereby to permit fabric of different widths to be treated by the apparatus of the invention.

The ammonia gas is introduced interiorly of the drum through a hollow shaft which is mounted at both its ends in rotatable gas-tight engagement with the walls of the sealed chamber. The drum is fixed to the hollow shaft and rotates therewith. Gas is introduced at the axial end of the hollow shaft and flows through apertures in the shaft located at interior portions of the drum.

The longitudinal seal is configured with a degree of curvature similar to the degree of curvature of the outer surface of the drum, and this seal is held in sliding engagement with the drum as the drum rotates.

The entrance and exit portals through which the fabric is introduced and removed from the sealed chamber are each configured to include an enclosed compartment, with each of the compartments having an entrance seal and an exit seal which permit the fabric to pass through the compartment while obstructing leakage of gas therethrough. Each of the seals comprises a pair of abutting members, at least one of which is formed from resilient material. The resilient material is positioned to maintain a spring force resiliently biasing the members into abutting relationship but permitting passage of the fabric therebetween, with the abutting spring force which is created operating to impede gas flow between the abutting members. As an additional expedient to prevent escape of gas from within the sealed chamber, each of the compartments includes suction means withdrawing therefrom any gas which may have leaked into the compartment.

A further significant aspect of the invention resides in the shape of the ceiling of the sealed chamber which operates to enhance removal of water from the chamber. The chamber ceiling is formed in a peaked configuration with a pair of oppositely directed downwardly sloping sides. By forming the ceiling with a slanted or sloping configuration, the water which is formed by the THPOH—$NH_3$ reaction tends to condense on the surface of the ceiling and will flow down the sloping sides thereof into troughs which are mounted within the chamber to collect the water runoff.

In the operation of the invention, gas introduced into the hollow shaft will flow into the interior of the drum through orifices formed in the hollow shaft at locations which will insure that the gas which is introduced into the drum enters at a point within the confines of the drum sealing means. By operation of the axial end seals and of the longitudinal sealing member, the gas is constrained to flow only through those drum perforations which are covered by textile fabric. The sealed treatment chamber has a vacuum applied thereto which serves to draw off the reaction products of the treatment process. Thus, a positive flow of gas is maintained through the apparatus which tends to enhance the ability of the apparatus to draw off the water vapor formed at the reaction site.

It is to be understood, and it will become apparent from the description which follows, that the present invention need not be limited in its scope and application to the treatment of textile fabric. Although the invention is particularly suitable in connection with the THPOH-$NH_3$ system of rendering fabric flame retardant, it may be found useful in other applications where different types of web material are to be treated by exposure to a gas. Thus, although the preferred embodiment of the present invention is described by reference to THPOH-$NH_3$ treatment of textile fabric it is to be understood that this is not to be necessarily taken in a limiting sense and that other types of web materials and other types of gas may be utilized in different applications of the present invention.

DETAILED DESCRIPTION OF THE DRAWINGS

The present invention will be better understood by reference to the following detailed description of a preferred embodiment thereof taken in connection with the accompanying drawings wherein.

Figure 3:
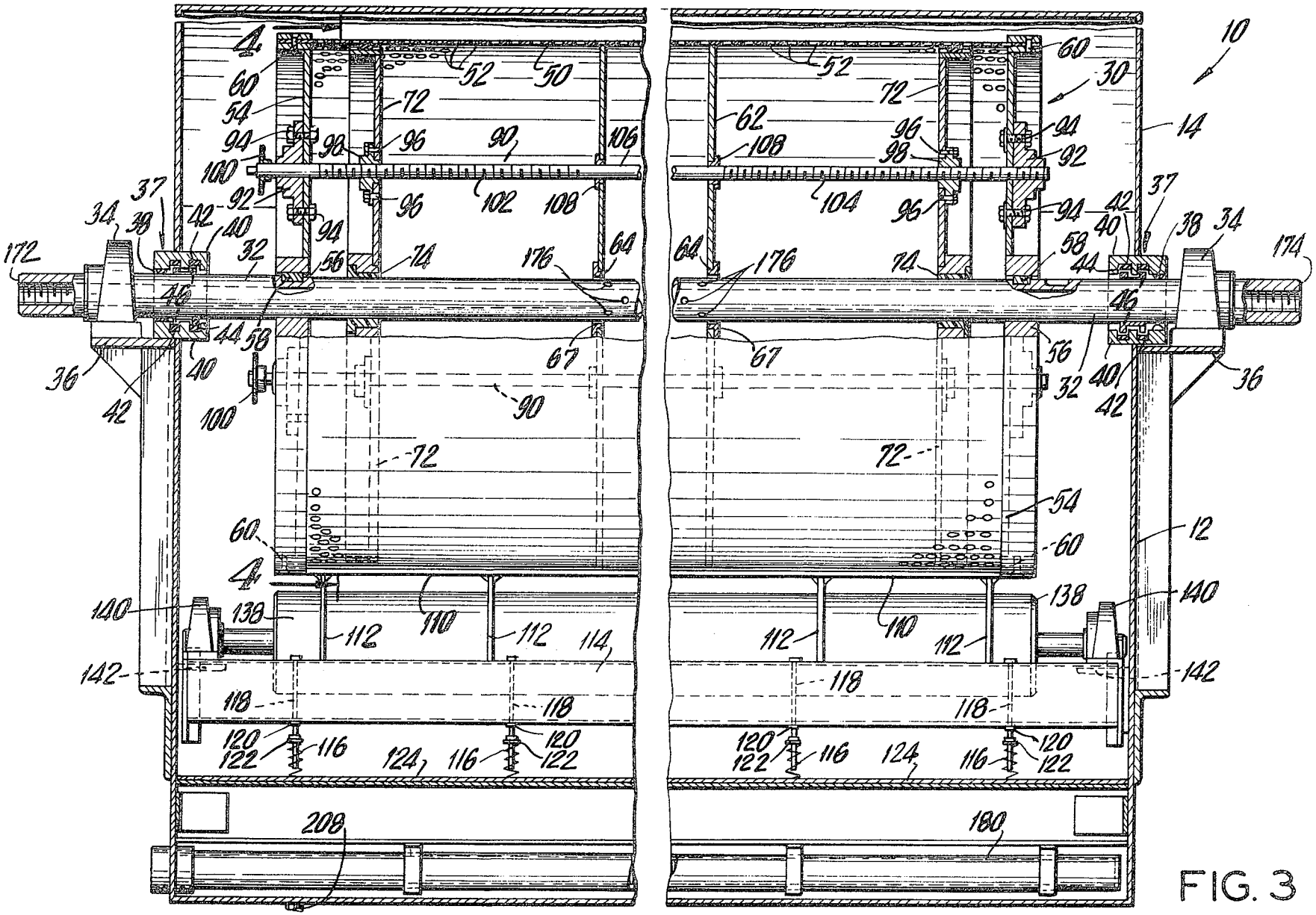
FIG. 3 is a sectional side elevation of the apparatus taken along the line 3—3 of FIG. 2.
Figure 4:
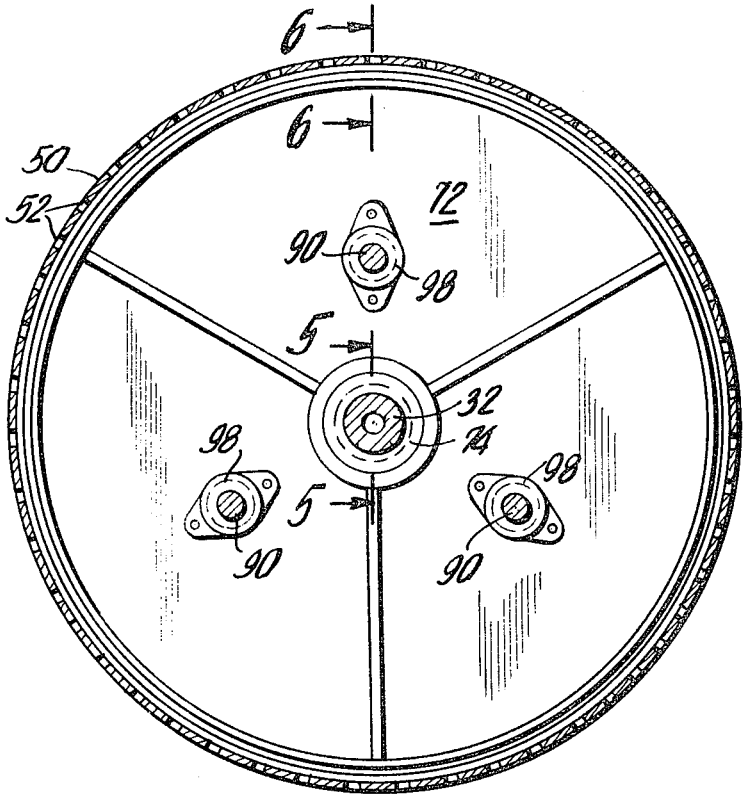
Figure 5:
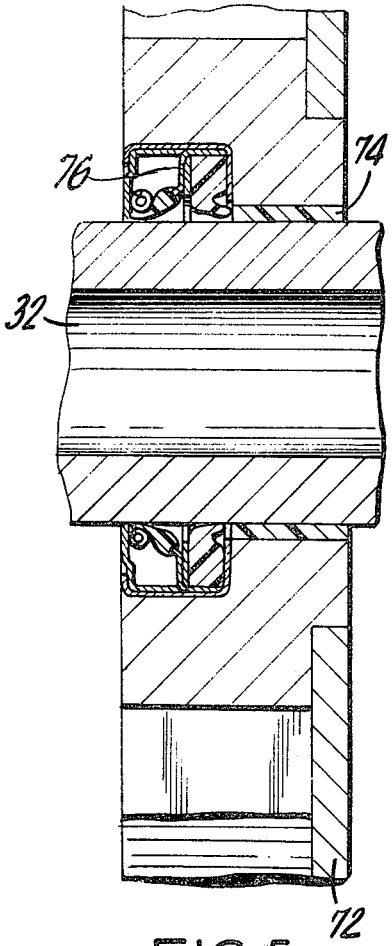
Figure 6:
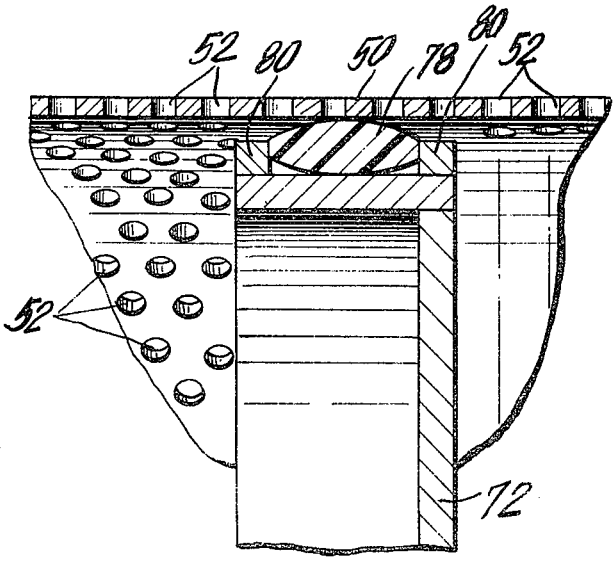

FIG. 4 is a sectional end elevation of a portion of the apparatus taken along the line 4—4 of FIG. 3; and FIGS. 5 and 6 are sectional views taken, respectively, along the lines 5—5 and 6—6 of FIG. 4 showing further details of the structure of the apparatus.

DETAILED DESCRIPTION OF THE PREFERRED EMBODIMENT

Figure 1:
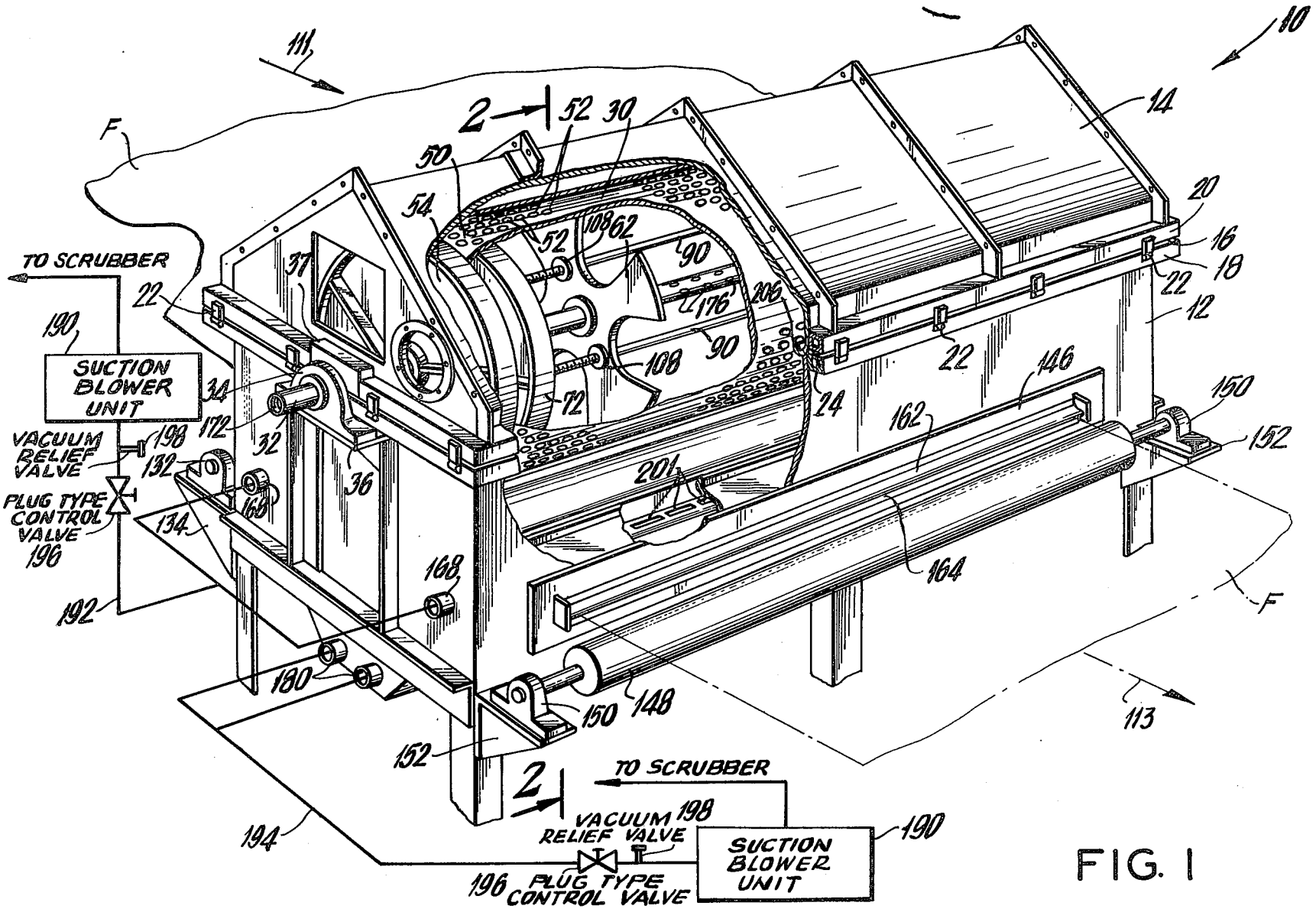
FIG. 1 is a perspective view partially broken away and partially schematic showing the overall structure of the apparatus of the invention.

Referring now to the drawings wherein like reference numerals refer to similar parts throughout the various figures thereof, there is shown a sealed outer chamber generally referred to by the numeral 10 which comprises a lower stationary section 12 and an upper removable section 14. The sections 12 and 14 are joined together along a sealing juncture 16 which extends circumferentially completely about the chamber 10. The sections 12 and 14 are formed with juncture beams 18 and 20 which extend, respectively, about the upper periphery of section 12 and the lower periphery of section 14. The beams 18 and 20 are releasably secured together by clips 22 spaced about the entire periphery of the chamber 10. A resilient sealing member 24 located between the beams 18 and 20 extends about substantially the entire periphery of the chamber 10 and maintains a gas-tight seal between the sections 12 and 14 when they are secured together by the clips 22 as shown in FIG. 1.

A perforated drum assembly 30 is rotatably mounted within the chamber 10 upon a hollow central shaft 32 which is supported at both its ends upon bearing assemblies 34 supported by stationary platforms 36 extending from the lower stationary section 12. The drum assembly 30 is fixed upon the shaft 32 to be rotatable therewith. The shaft 32 is, in turn, supported by the bearings 34 to be rotatable relative to the chamber 10. The shaft 32 may be driven for rotation in any conventional manner by a driving assembly (not shown) which may comprise a belt and pulley arrangement located externally of the chamber 10.

The chamber 10 is structured to include a pair of sealing assemblies 37 which mount the shaft 32 in a gas-tight rotatable relationship relative to the chamber 10. Each of the assemblies 37 includes a split resilient sealing ring 38 extending circumferentially about the shaft 32 and supported in wiping engagement therewith by seal blocks 40 formed as part of the lower and upper sections 12 and 14. The seal blocks 40 each include a pair of semi-circular slots 42 each having mounted thereon one-half of a sealing ring 44 which is supported thereby in wiping engagement with one of a pair of annular projections 46 extending about the shaft 32. It will be seen that the resilient members 38 and 42 enable the shaft 32 to rotate relative to the chamber 10 while maintaining a gas-tight seal therebetween.

The drum assembly 30 includes a perforated outer shell 50 having spaced perforations 52 extending completely through the thickness of the shell 50 and dispersed throughout the entire surface area thereof. A pair of circular end plate members 54 operate to fixedly mount the shell 50 upon the shaft 32. Each of the plates 54 includes a centrally located opening 56 through which the shaft 32 extends with a pair of round-end keyways 58 being provided to rigidly mount the plate 54 upon the shaft 32. The ends of the shell 50 are attached to the outer peripheries of the plate 54 by a set of mounting screws 60.

A pair of support plates 62 are mounted within the drum assembly 30 at central, axially spaced apart locations in order to provide radial support for the shell 50. Each of the plates 62 comprises centrally located openings 64 through which the shaft 32 extends, with a pair of circular mounting plates 67 being provided to attach the plates 62 with a press fit upon the shaft 32. The plates 62 include radially extending cut outs 66 located between solid spokes 68 each having outer circumferential extremities 70 shaped with a degree of curvature matching the inner surface of the shell 50 and located in abutment therewith to provide suitable radial support. It should be noted that the cutouts 66 will enable gas flow between the inner sections of the drum assembly 30 separated by the support plates 62.

The drum assembly 30 also includes a pair of axially adjustable sealing plates 72 interposed between each of the plates 54 and 62. Resilient bushings 74, which may be formed of Teflon (polytetrafluoroethylene) or other suitable material, mount the plates 72 in a gas-tight manner for axial sliding engagement along the shaft 32. A conventional oil seal assembly 76 mounted adjacent the bushing 74 permits appropriate lubrication thereof in a conventional manner thereby facilitating sliding engagement of the plates 72 upon the shaft 32. A pair of sealing rings 78, which may be formed of Teflon or other suitable material, extending completely about the outer periphery of each of the plates 72 are each mounted between a pair of annular projections 80 to enable gas-tight sliding engagement between the plates 72 and the inner surface of the perforated shell 50.

Each of the plates 72 is threadedly engaged by adjustment screw shafts 90 which extend completely across the length of the drum assembly 30 having their ends rotatably mounted in the end plates 54 by flange bearing members 92 fixed upon the plate 54 by bolts 94.

The sealing plates 72 have mounted thereon, by means of bolts 96, a plurality of threaded carrier nuts 98 which threadedly engage the shafts 90 to effect axial displacement of the plates 72. It will be apparent that rotation of the shafts 90 by means of toothed sprockets 100 mounted at one end of the shafts will cause a driving force to be applied through the threaded engagement between the shafts 90 and the carrier nuts 98 driving the plates 72 in unison leftwardly or rightwardly, as viewed in FIG. 3, along the length of the drum assembly 30. The toothed sprockets 100 may be engaged by a conventional driving belt (not shown) which will effect simultaneous rotation of the sprockets 100 and of the shafts 90. Thus, the plates 72 may be moved in unison axially along the length of the drum assembly 30 to desired positions. The shafts 90 comprise oppositely threaded sections 102 and 104 and a central unthreaded portion 106 which is freely rotatably supported in bearing members 108 mounted upon the support plates 62.

As will be evident from FIG. 4, the apparatus includes three screw shafts 90 equivalently spaced about the shaft 32. Each of the three shafts is rotatively supported at its ends by a pair of flange bearing members 92 mounted on the plates 54. Additionally, each shaft 90 threadedly engages the sealing plates 72 through a pair of threaded carrier nuts 98 mounted upon respective plates 72.

An arcuate sealing member 110 formed of Teflon or other suitable material is positioned for sliding engagement with the bottomost section of the perforated shell 50. The sealing member 110 is formed with an upper arcuate surface generally conforming to the outer circumference of the shell 50 and is sized to extend the full length of the shell 50. A plurality of upright support members 112 extend between a longitudinal support beam 114 and the sealing member 110, and a plurality of adjustment spring members 116 are provided to enable adjustment of the sliding pressure of the sealing member 110 against the bottom of the shell 50. Adjustment bolts 118 dependently supported from the longitudinal beam 114 by nuts 120 have an adjustment nut 122 threadedly engaged upon the lower threaded portions thereof with the spring members 116 being held in compression between the adjustment nuts 122 and a lower I-beam 124 which extends longitudinally of the assembly. Compression of the spring members 116 may be adjusted by manipulation of the adjustment nuts 122 thereby enabling adjustment of the bearing pressure of the sealing member 110 against the shell 50. The sealing member 110 is maintained against the bottom section of the shell 50 with sufficient pressure to prevent gas flow through the perforations 52 whose openings abut the upper surface of the sealing member 110 while enabling smooth sliding engagement of the outer surface of the shell 50 upon the upper surface of the sealing member 110.

Figure 2:
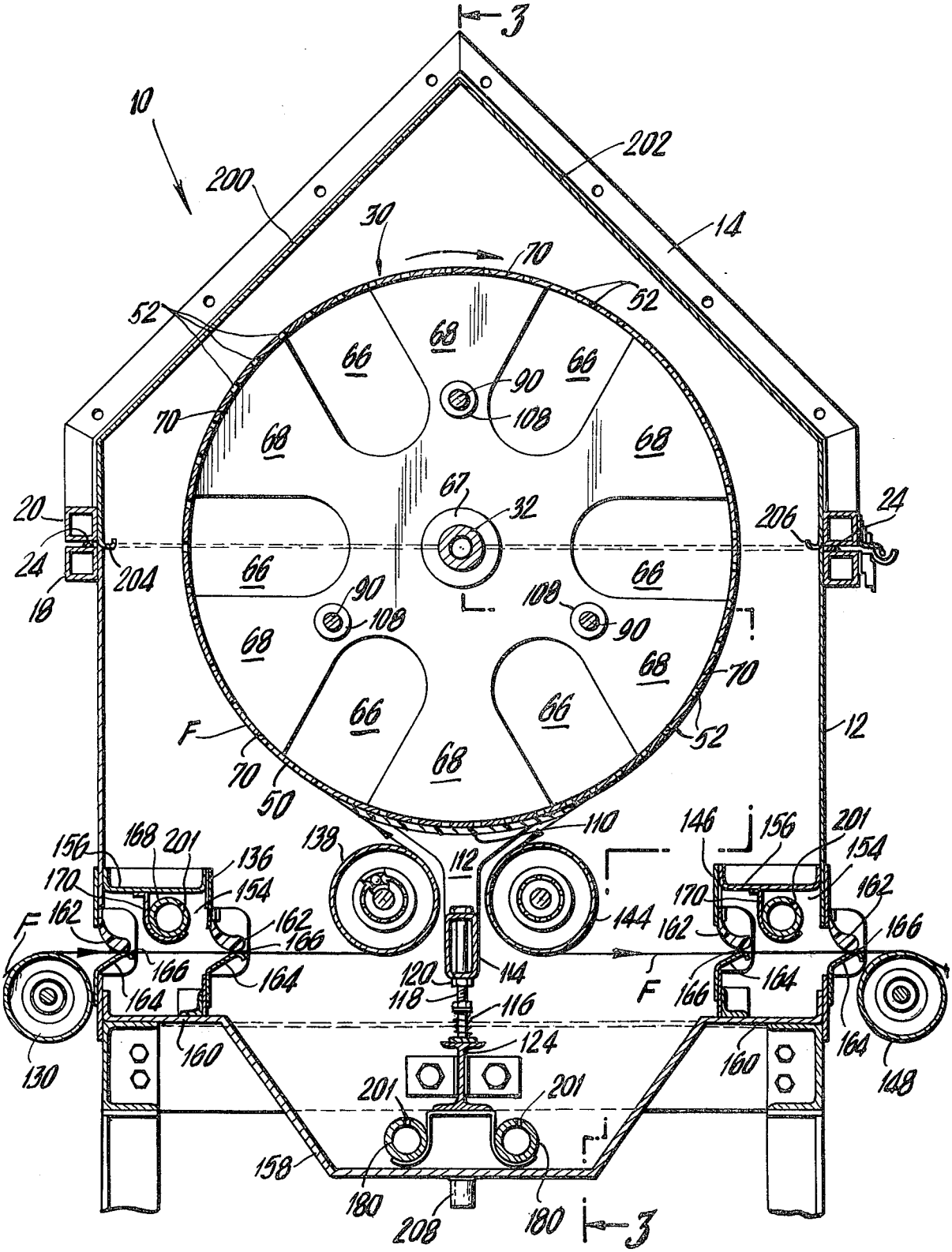
FIG. 2 is a sectional elevation taken along the line 2—2 of FIG. 1 showing an end view of the apparatus.

The fabric F which is to be treated by the apparatus of the present invention is introduced into the sealed chamber 10 from the rear of the chamber as indicated by the arrow 111 in FIG. 1, with the treated fabric passing out of the chamber from the front side of the apparatus, in the view thereof shown in FIG. 1, as indicated by the arrow 113. Thus, with the reference to FIG. 2, the fabric F enters the chamber 10 from the left after passing over an external input guide roller 130 which extends along the length of the chamber 10 and which is rotatively supported at both its ends by bearing members 132 mounted upon a platform 134 supported upon the exterior of the chamber 10.

The fabric F enters the sealed chamber through an inlet compartment generally labelled 136 and passes about an internal input guide roller 138 which is rotatively mounted at both ends by bearing members 140 supported upon plates 142 attached to the interior walls of the chamber 10. After passing beneath the roller 138, the fabric extends over and about the shell 50 and then winds beneath an internal output guide roller 144 which is mounted within the chamber 10 in a manner identical to the input guide roller 138. Subsequently the fabric F passes through an exit compartment 146 from which it leaves the chamber 10 whereupon it extends about an external outlet guide roller 148. The outlet guide roller 148 is supported upon the exterior of the chamber 10, in a manner similar to the roller 130 by means of bearings 150 mounted upon platforms 152 which are attached to the exterior of the chamber 10, with the bearings 150 rotatively supporting each end of the roller 148.

The compartments 136 and 146 are substantially identical in configuration and comprise entrance and exit portals permitting the fabric F to enter and leave the chamber while obstructing escape of gas therefrom. Each of the compartments 136 and 146 is generally shaped as an elongated completely enclosed box mounted upon the internal walls of the chamber 10, with each compartment comprising a pair of end walls which extend parallel to the plane of the drawing of FIG. 2, with only one of the end walls 154 being visible for each of the compartments. Upper walls 156 comprise a concave configuration and serve as gutters or troughs through which moisture accumulating in the chamber 10 may be drawn off. A lower wall 158 closing off the bottom of the chamber 10 extends through flange sections 160 to form the bottom enclosures for the compartments 136 and 146.

Each of the compartments 136 and 146 is formed with a pair of longitudinally extending sealing means each comprising an upper resilient sealing member 162, which may be made of Teflon or other suitable material, and a lower rigid sealing member 164 which may be formed from light metallic material such as spring steel. The members 162 and 164 are mounted upon the side walls of the compartments in the positions indicated in FIG. 2 of the drawings, by any suitable conventional means such as bolting, riveting, welding or the like. The mounting of the members 162 and 164 must be such that the ends thereof are brought into firm engagement along a line 166 thereby to form a nip through which the fabric F passes. Since the member 162 is made from resilient material, a compressive spring force is established by virtue of the flexing of the member 162 which tends to retain the members 162 and 164 pressed together along the line of engagement 166 thereby preventing escape of gas through the contact line established between these members. Thus, the interiors of the compartments 136 and 146 may be maintained in a substantially gas-tight condition while permitting passage of the fabric therethrough between the members 162 and 164.

Since it is possible that some gas may escape from the interior of the chamber 10 through the innermost members 162 and 164, into the interiors of the compartments 136 and 146, these compartments are further provided with suction pipes 168 mounted upon support elbows 170 hung from the upper walls 156 of the compartments. In a manner to be more fully described hereinafter, the suction pipes 168 draw off any gas which may leak from the interior of the chamber 10 into the interiors of the compartments 136 and 146 thereby avoiding any leakage of such gas between the outermost sealing members 162 and 164.

The compartments 136 and 146 are configured to enable gas-tight movement of fabric F through the chamber 10 while allowing fabric of various widths to be treated. It will be seen that if the fabric F is of a width which is of a dimension less than the length of the engagement line 166 between sealing members 162 and 164, substantially gas-tight movement of fabric therethrough will nevertheless be effected due to the fact that the sealing members 162 and 164 will be maintained in resilient engagement along the line 166 at the extremities thereof where no fabric is passing therebetween. The members 162 must be of a resiliency sufficient to permit fabric of ordinary thickness to pass through the compartments 136 and 146 without permitting separation between the members 162 and 164 at the outer extremities thereof along the line 166 when the width of the fabric is less than the overall length of the engagement line 166.

As has been previously noted, the general overall chemical process whereby fabric is treated to impart thereto characteristics of inflammability usually involves treatment of the fabric prior to its introduction into the apparatus previously described herein. Thus, the specific chemical process for which the present invention is particularly intended is carried out by first impregnating the fabric with an aqueous THPOH solution prior to its introduction into the inlet compartment 136.

Fabrics suitable for treatment with the present process are those containing at least about 50 percent by weight of a cellulosic component, which preferably is cotton. The present process is particularly suitable for fabrics containing at least about 50 percent by weight cotton with the remainder being polyester.

The solution with which the fabric is first impregnated will usually involve a concentration of THPOH which is greater than about 15 percent. It is, of course, well known that THPOH is not a shelf chemical. Rather, such a solution is prepared by mixing tetrakis (hydroxymethyl) phosphonium chloride with an alkaline solution, generally a sodium hydroxide solution. Additional agents, e.g., wetting agents, usually in concentrations from about 0.5 to 5.0% may be added. Typical wetting agents which can be used in the present process include those non-ionic surface active agents conventionally used in the art. Examples, of such materials include ethylene oxide condensates or alkyl phenols, fatty acid glycol esters, phosphated esters, polyhydric alcohol fatty acid esters, and the like.

The impregnation of the fabric may be performed by any of the methods well known to the art. Typically, the fabric may be dipped or padded with the impregnating solution. Usually, the fabric would be padded to about a 100% pick-up. Thereafter, the fabric is usually dried to a moisture content in the range from about 5 to 35%, and preferably 12 to 20% by weight, at a temperature and drying rate sufficient to prevent migration of the solution on the fabric. That is to say during and after the drying, the fabric should be uniformly wet.

The impregnated fabric is then subjected to ammoniation in the apparatus hereinbefore described in a manner to be described in more detail hereinafter. Understandably, the amount of ammonia used to treat the fabric must be sufficient to chemically react with the THPOH impregnated into the fabric. Generally, the amount of ammonia used will depend on a number of factors, such as, the weight of the fabric, the speed of the fabric through the apparatus, etc. Each of these parameters can be determined at the time of processing, depending on the end result desired. Gas flows of ammonia through the apparatus, i.e., through the fabric, are generally in the range from about 0.75 to 3.0 pounds per minute and preferably in the range from about 1.75 to 2.5 lb./min.

Additionally, it is possible to dilute the ammonia gas flowing through the fabric with air or other inert gas which does not react with the treating agents. By virtue of such dilution, savings in the amount of ammonia used can be effected.

After having been treated in the apparatus herein described, the fabric is lagged for a sufficient period of time to allow the reaction to go to completion. Typically, such lag times are in the range from about 15 seconds to 3 or 4 minutes, although longer lag times may be used, again, depending on the nature of the fabric and the processing speed, etc.

Thereafter, the fabric is washed with water, and subjected to an oxidation step while it is wet, usually with a solution of a peroxide type agent. Typical of such peroxides are hydrogen peroxide and sodium perborate. If desired, the peroxide solution may contain a silicate compound, e.g., sodium silicate. Typically, the oxidation step comprises the washing of the fabric with a solution containing from about 1 to 8% and preferably from about 3 to 6% by weight of peroxide and from about 0.5 to 5%, and preferably 1 to 3% by weight of silicate. Thereafter, the fabric is lagged for a period of time from about 1 to 5 minutes and then subjected to a conventional water wash and drying step.

Fabrics treated by the foregoing process in the apparatus of the present invention possess superior durable fire-retardancy as measured by standard test DOCFF 3-71. Normally, fabrics produced in accordance with the present invention exhibit a char length of less than seven inches.

The mechanism of the chemical reaction of THPOH with $NH_3$, which occurs during ammoniation of the fabric in the apparatus of the present invention is not clearly understood. It is known that the ammonia causes polymerization of the THPOH in the interstitial spaces of the individual fibers. This reaction is basically a dehydration type reaction and is accompanied by the formation of water. Thus, in order for the reaction to be driven to completion, the water which is formed must be suitably removed in sufficient quantities from the reaction site. Accordingly, as will be apparent from the description which follows, one of the principal benefits derived from the present invention is the fact that adequate water removal from the reaction site may be effected without seriously impairing the chemical reaction which must occur between the THPOH and the $NH_3$, i.e., by inadequate exposure of the fabric to $NH_3$ which may result from a lack of sufficient quantities of $NH_3$ at the reaction site for a sufficient period of time.

Ammonia gas is introduced into the apparatus of the present invention through the hollow shaft 32. Typically, the ammonia may be introduced through the end 172 of the shaft 32 with the opposite end 174 being capped by a closure member (not shown). Located centrally of the shaft 32 are a plurality of gas outlet orifices 176 whose axial location relative to the length of the shaft 32 is limited to that portion of the shaft length extending between the support plates 62. Ammonia gas flowing interiorly of the shaft 32 will be directed through the orifices 176 into the internal volume of the drum assembly 30 defined between the support plates 62. Gas will then flow through the cutouts 66 into the volume located between each of the sealing plates 72 and the next adjacent support plate 62. From there gas will be directed through the perforations 52 in the shell 50 and through the fabric F which is wound about the outer surface of the shell 50. The gas flowing through the fabric F will then occupy the internal volume of the chamber 10 and the reaction products formed by virtue of the exposure of the THPOH-impregnated fabric with the ammonia gas will be drawn off through a pair of exhaust tubes 180 mounted in the lower end of the chamber 10.

It will be seen that the gas flowing from the interior of the shell 50 through the perforations 52 will be confined by the sealing plates 72 and by the sealing member 110 to flow only through those perforations 52 which are located between the plates 72. As has been previously stated, the plates 72 are in sealing engagement with the interior of the shell 50. Accordingly, no gas will flow in the perforations located on the outboard side of the plates 72. Therefore, by proper axial adjustment of the plates 72 in the manner previously described, gas flow can be strictly confined to the portion of the length of the shell 50 extending between the plates 72. As a result, the apparatus is equipped to effect treatment of fabric of varying widths. By adjusting the location of the plates 72 so that the sealing rings 78 are located at the edges of the fabric passing about the shell 50, substantially all of the gas flowing in the apparatus will be confined to flow directly through the fabric F and, depending upon the limitations of travel of the plates 72, fabric of almost any width may be processed in a manner whereby all of the gas passing through the apparatus is forced to flow directly through the fabric.

Of course, it will be seen that in addition to the sealing plates 72, the arcuate sealing member 110 located at the bottom of the shell 50 also cooperates to insure that substantially all the gas flowing through the apparatus passes directly through the fabric. As will be seen in FIG. 2, the fabric F, as it leaves the guide roller 138 extends over the leftmost edge of the sealing member 110. Similarly, as the fabric leaves the shell 50 and winds about the guide roller 144, it moves over the rightmost edge of the sealing member 110. Thus, some overlap between the fabric as it moves onto and off the shell 50, and the right and left edges of the sealing member 110, as viewed in FIG. 2, will exist and as a result of this overlap any gas which flows from the interior of the shell 50 must pass through the perforations 52 and through the fabric. It will be noted that the sealing member 110 may extend the complete length of the shell 50 and need not be longitudinally adjustable. Inasmuch as the sealing members 72 will be located at points coinciding with the edges of the fabric, no gas will flow in portions of the shell 50 outboard of the plates 72 thereby making longitudinal adjustment of the sealing member 110 unnecessary. Of course, vertical adjustment of the sealing member 110 in a manner previously described by manipulation of the adjustment nut 122 may be necessary, but this is primarily for the purpose of assuring that a smooth sliding engagement between the shell and the member 110 can occur without permitting gas leakage.

Thus, it will be seen that the sealing member 110 extends, with regard to its width dimension, across that portion of the circumferential perimeter of the shell 50 which is not covered by fabric F. Since the fabric cannot extend completely around the entire circumference of the shell 50, the member 110 provides the necessary sealing action across that portion of the shell circumference not covered by fabric to insure that substantially all the gas within the shell 50 will flow through those perforations 52 which are covered by fabric.

Thus, it will be seen that the gas flowing through the apparatus of the present invention is confined by the physical elements of the apparatus to flow in a defined path in such a manner that substantially all of the gas is constrained to pass through the fabric F. The fabric F is brought to a treatment location which is the position which the fabric F occupies as it is winding about the shell 50. The flow path of the gas is initiated at the interior of the shaft 32 and continues through the orifices 176 into the interior central portion of the drum assembly 30, through the cutouts 66 and through the perforations 52 which are not blocked by the plates 72 or by the lower arcuate sealing member 110. Thus, the gas flow path is defined as passing through the treatment location at which the fabric is to be located, with substantially all of the gas in the defined flow path passing through the treatment location and through the fabric.

It should be noted that it is an essential part of the present invention that the sealing plates 72 be located at the edges of the fabric F. It has been found that if the sealing plates 72 are positioned at locations spaced from the edges of the fabric, thereby allowing gas to flow through perforations 52 which are not covered by fabric, then the gas will tend to flow through those perforations 52 which are not covered and an insufficient quantity of gas will flow through the fabric. It has been found that even a gap of about 1/64 of an inch between the edges of the fabric and the respective plate 72 proximate to that edge will be sufficient to seriously impede operation of the process of the invention by permitting excessive quantities of gas to pass through the uncovered perforations thereby preventing required fabric exposure to the gas and resulting in an inadequate treatment of the fabric.

In a specific treatment procedure utilizing the present invention, 100% cotton fabric having a width of approximately 50 inches was treated with the flow of ammonia gas at ambient temperature through the apparatus being maintained within a range of approximately 1 to 3 pounds per minute and preferably at a flow rate of approximately 2 lbs./min. The concentration of $NH_3$ in the gas was approximately 100 per cent and the speed of the fabric passing about the shell 52 was maintained within a velocity range of between about 15 and 20 yards per minute, with the preferred fabric velocity being about 20 yards per minute.

It should be noted that while the gaseous ammonia is introduced to the chamber at ambient temperatures, the exothermic nature of the condensation reaction described hereinabove as well as the heat of solution of ammonia in the water present cause a rise in temperature within the chamber. Generally, it is desirable to carry out the reaction at as low a temperature as possible since, of course, the heat build-up can slow down the reaction.

The fabric thus treated was found to possess superior fire-retardant characteristics. A comparison between fabric treated by the process and apparatus of the present invention and fabric treated by prior art techniques of merely exposing the fabric to the ammonia gas without constraining the gas to pass directly through the fabric, i.e., the "surface adhesion" method, indicated that fabrics treated in accordance with the present invention possess superior characteristics for a given quantity of ammonia gas passing through the treatment apparatus. Thus, in the prior art arrangements, a greater amount of ammonia gas is necessary to obtain results similar to those obtained with the present invention. Furthermore, it was found that with the required increased flow rates of ammonia necessary to achieve satisfactory results from the point of view of exposure of the fabric to sufficient quantities of ammonia, other problems relating to the accumulation of moisture in the treatment apparatus arose in connection with prior art techniques thereby having a detrimental affect upon the treatment process.

As previously stated, gas is withdrawn from the apparatus of the present invention through a pair of suction exhaust pipes 168 located within the chambers 136 and 146 and through a pair of suction exhaust pipes 180 located in the bottom of the chamber 10. As best seen in FIG. 1, each of these exhaust pipes is vented by an individual suction blower unit 190 which draws exhaust gas for delivery to a scrubber (not shown) located externally of the apparatus. The pipes 168 are vented through a flow path generally indicated by the reference numeral 192 and the pipes 180 are vented through flow path 194. Each of these flow paths includes a plug type control valve 196 and a vacuum relief valve 198. The blowers 190 are of the positive displacement type which operate in a manner to reduce leakage. The vacuum relief valves 198 operating in conjunction with the control valves 196, relieve vacuum in the lines 192 and 194 when the blowers 190 become overloaded. That is, if insufficient gas in being withdrawn from the apparatus, the blowers 190 may have a tendency to overrun thereby causing potential overheating of the blowers. When this occurs, the vacuum relief valves 198 will open thereby drawing air from the atmosphere to avoid blower overload.

Each of the exhaust pipes 168, 180 are formed with a plurality of rectangular intake slots 201 through which gas from the interior of the respective chambers in which the pipes are located may pass into the hollow internal portions of the pipes. These slots are best shown in FIG. 1 for the nearmost pipe 168, but it is to be understood that an identical or similar structure, whereby gas intake into the pipes may occur, is provided for each of the pipes 168, 180.

In the operation of the present invention it was found preferable to maintain a ratio of flow rates between the lines 194 and 192 of approximately 2:1. Thus, the line 194 should preferably have approximately double the rate of flow of the line 192. Specifically, it was found preferable to operate the blowers 190 so that the line 194 was maintained with a flow rate within the range of from about 50 to 250 c.f.m. while the line 192 was maintained with a flow rate within the range from about 25 to 125 c.f.m.

As has been previously noted, the ammonia gas passing through the perforations 52 and through the fabric F effect a reaction at the fabric between the THPOH and $NH_3$ Water is a product of the reaction and in order to prevent undue accumulation of moisture in the apparatus several expedients are utilized. First of all, the upper removable section 14 is formed with downwardly sloping sides 200 and 202. As the gas passes through the fabric, the water products of the reaction process will have a tendency to condense upon the ceiling of the chamber 10 and the condensate will flow downwardly along the sides 200 and 202 and will be accumulated in gutters 204 and 206 located approximately midway down the interior sides of the apparatus. Gutters 204 and 206 extend along the length of the apparatus and as water flows down the sloping inner ceiling it will accumulate in the gutters 204 and 206 from which it may be suitably withdrawn.

Furthermore, it was previously noted that the compartments 136 and 146 are formed with upper wall troughs 156. Each of these troughs similarly serves to assist in withdrawing the water which is formed, and any excess quantitites of water which do not accumulate in the gutters 204 and 206 will run down into the troughs 156 and likewise be drawn off therefrom.

Accordingly, it will be seen that the combination of the sloping interior ceiling and the gutters 204, 206 together with troughs 156 result in a cooperation between the elements which serves to advantageously prevent undue water accumulation within the apparatus which might otherwise impede the treatment process.

An additional characteristic of the present invention which enhances its ability to prevent undue water accumulation is the fact that because the ammonia is constrained to flow directly through the fabric, gas flow velocities in excess of those utilized in prior art techniques may be maintained. That is, since the ammonia gas is constrained to flow directly through the fabric rather than merely permeating the atmosphere surrounding the fabric, a more definite stream of gas flow is established. This serves to enhance the ability of the equipment to remove from the reaction site by virtue of the fact that the gas flow tends to carry off water vapor which is formed. If the vapor condenses, the condensate will tend to accumulate upon the ceiling of the chamber 10 and be drawn off through the gutters 204, 206 and the troughs 156 as previously described. Thus, the particular cooperation which is effected between the combination of ammonia gas flow and the interior structural configuration of the apparatus, serves to effectively deal with the problem of water accumulation whether the water be in vapor form or in the form of condensate.

An additional significant advantage of the present invention relates to the fact that, due to the overall configuration and operation of the apparatus disclosed, the chamber 10 may be maintained at a slight negative pressure relative to the surrounding atmosphere. It will be seen that such a negative pressure will be consistent with the type of gas flow pattern which is established in that a relatively negative pressure within the chamber 10 will promote the flow of gas outwardly from the shell 50. However, such a negative pressure has the further advantage that it will insure that no leakage outwardly from within the chamber 10 will occur. Thus, the leakproof characteristics of the apparatus whereby no ammonia gas will escape into the surrounding environment are further enhanced by the relatively negative pressure which is maintained within the chamber.

In addition to preventing gas leakage, the slightly negative pressure maintained within the chamber 10 serves the further purpose of inhibiting condensation of the water which is produced by the reaction process. In many prior art devices utilizing the "surface adhesion" approach, a positive pressure must be maintained within the treatment chamber to promote permeation of the ammonia upon the fabric. Thus, water vapor will tend to condense upon the fabric thereby inhibiting the reaction process. The negative pressure which may be maintained within the chamber 10 of the present invention avoids this drawback thereby further facilitating the removal of the water.

Waste products which accumulate in the chamber 10 may be drawn off through the bottom of the chamber by a condensate drainpipe 208 located in the bottom of the apparatus.

A further advantage of the present invention resides in the fact that the gas flowing through the perforations 52 and through the fabric F tends to lift the fabric radially outwardly from the shell 50. This lifting force is maintained at a level which is not sufficient to break the seal between the fabric and the shell 50 so that all of the gas flows through the fabric rather than around the edges thereof. However, this slight lifting force operates to avoid fabric distortion which might result if the fabric were to be wound about the shell 50 with an overly tight tension in the fabric. By alleviating pressure of the fabric upon the shell 50 fabric distortion such as might occur from engagement of the fabric with the edges of the perforations 52 is avoided.

Although the present invention has been disclosed by detailed reference to a preferred specific embodiment thereof, it is to be understood that many modifications and variations may be effected by those skilled in the art without departure from the scope and purview of the invention.

What is claimed is:

1. A method for treating a continuous length of textile fabric composed of greater than about 50 percent by weight cellulose previously impregnated with THPOH with gaseous ammonia to impart thereto flame-retardant characteristics, said method being applicable to textile fabrics of various widths wherein said method comprises the steps of flowing a gas selected from the group consisting of ammonia and mixtures of ammonia and air or an inert gas in a confined gas flow path through a hollow cylindrical shell having a cylindrical wall with orifices therethrough, said shell being rotatably mounted within a substantially gas-tight treatment chamber, continuously passing said textile fabric through the interior of said treatment chamber in a manner such that a plurality of the orifices of the cylindrical shell are covered by said fabric and at a line speed within the range from about 15 to 50 yards per minute corresponding to the speed of rotation of the cylindrical shell, and constraining substantially the entire amount of said gas flowing in said path through the orifices covered by said textile fabric and across the path of the said textile fabric to flow directly through said textile fabric, the rate of flow of said gas being within the range from about 0.75 to 5 pounds per minute and being sufficient to substantially reduce the contact pressure between said textile fabric and said hollow cylindrical shell and wherein said treatment chamber has a vacuum applied thereto which serves to draw off the reaction products of the treatment process and ensure a positive flow of gas from the interior of said hollow cylindrical shell.

2. The method of claim 1 wherein the fabric contains greater than about 50 percent by weight cotton.

3. The method of claim 2 wherein the remainder of the fabric is polyester.

4. The method according to claim 1 wherein the rate of flow of said gas is about 2 pounds per minute and wherein the speed of said textile fabric is about 20 yards per minute.

5. The method according to claim 1 wherein the rate of flow of said gas flowing through said textile fabric is at least about 2 pounds per minute.

* * * * *